United States Patent [19]

Maitenaz et al.

[11] Patent Number: 4,590,360

[45] Date of Patent: May 20, 1986

[54] COOKING CHAMBER APPARATUS

[75] Inventors: Paul Maitenaz, Olivet; Alain Gernez, Orleans, both of France

[73] Assignee: Compagnie Europeenne pour l'Equipement Menager "Cepem", France

[21] Appl. No.: 546,226

[22] Filed: Oct. 27, 1983

[30] Foreign Application Priority Data

Oct. 29, 1982 [FR] France ..... 82 18163
Feb. 17, 1983 [FR] France ..... 83 02576

[51] Int. Cl.[4] ..... F27D 11/00

[52] U.S. Cl. ..... 219/390; 126/273 R; 219/407; 219/392

[58] Field of Search ..... 219/390–413, 219/415, 521, 548; 126/273 R, 273 A

[56] References Cited

U.S. PATENT DOCUMENTS

| | | | |
|---|---|---|---|
| 1,657,205 | 1/1928 | Ehrgott | 219/400 |
| 2,552,641 | 5/1951 | Morrison | 219/521 |
| 2,607,876 | 8/1952 | Bergen | 219/415 |
| 3,155,814 | 11/1964 | Appleman | 219/407 |
| 3,336,465 | 8/1967 | Hurko | 219/397 |
| 3,626,155 | 12/1971 | Joeckel | 219/407 |
| 4,286,143 | 8/1981 | Tadewald | 219/548 |

FOREIGN PATENT DOCUMENTS

| | | |
|---|---|---|
| 946923 | 6/1949 | France . |
| 2193180 | 2/1974 | France . |

*Primary Examiner*—Clarence L. Albrition
*Assistant Examiner*—Teresa J. Walberg
*Attorney, Agent, or Firm*—Sughrue, Mion, Zinn, Macpeak, and Seas

[57] ABSTRACT

Apparatus in the form of at least one cooking chamber, e.g. a cooker or an oven for building into a kitchen unit, with the cooking chamber being delimited by a generally rectangular muffle (20) having an open front face. Heater elements (41) are disposed inside the muffle and/or outside the muffle in a contiguous chamber, and a thermally insulating material (50) is moulded over the side walls of the muffle together with the contiguous chamber if present. The thermally insulating material constitutes the core of a frame for the apparatus and forms part of a structure which provides at least a portion of the outside walls of the apparatus. Moulding the insulating material directly over the cooking chamber facilitates manufacture and reduces heat losses through heat-conducting bridges.

11 Claims, 6 Drawing Figures

COOKING CHAMBER APPARATUS

The invention relates to apparatus comprising at least one cooking chamber delimited by a generally rectangular muffle having an open face, with heater elements being disposed inside the muffle and/or outside the muffle in a contiguous chamber, and a thermally insulating material covering the side walls of the muffle together with said contiguous chamber, if present.

The term "side walls" is used to denote the four walls adjacent to the open face of the muffle, and said open face is hereafter referred to as the "front" face.

BACKGROUND OF THE INVENTION

It is desirable to raise cooking chambers to their operating temperature as quickly as possible while suffering minimum heat losses, thereby reducing energy consumption.

With known apparatus, the rise in temperature is relatively long because large quantities of heat are lost by conduction to the frame of the apparatus, and these heat losses result in a temperature increase of the outside walls of the apparatus. Standards are laid down which impose maximum permissible temperatures for the outside walls or cladding of cooking apparatus when in use. For example the temperature may not exceed 100° C. for free-standing apparatus, nor 90° C. for built-in apparatus. It is thus necessary to evacuate the heat lost from the cooking chamber by interposing chimney ducting between the frame and the outer cladding to promote air circulation which may be by natural convection or else forced if a fan is incorporated.

French patent publiction No. 2 193 180 (CEPEM) describes a cooking chamber delimited by a muffle having heat insulation on its outside surface, the muffle is itself located in a frame which also has heat insulation on its outside surface and to which an outer cladding of sheet metal is fixed. This design which uses three layers of sheet metal (the muffle, the frame, and the cladding) nonetheless suffers from some of the thermal drawbacks mentioned above, since the assembly points between the three layers constitute heat bridges and the heat lost by the chamber still needs to be evacuated by chimney ducting located between the frame and the outer cladding. This design also suffers from mechanical problems in that manufacture is relatively complex because of the large amount of sheet metal working and enamelling.

French Pat. No. 946 923 describes an electric oven comprising a muffle covered by a sealed box of fibro-cement which is made independently from the muffle and which is subsequently placed around it. This method of assembly leads to poor insulation and to poor mechanical strength. Further, it does not lend itself to robotization.

Preferred embodiments of the present invention avoid the thermal drawbacks of the prior art by providing a cooking chamber apparatus which does not have heat bridges, thereby limiting heat losses from the chamber by conduction.

Such preferred embodiments also have reduced problems of mechanical strength by eliminating some of the delicate manufacturing operations that have previously been required. This is achieved by assembling the main components of the apparatus (chamber, heat insulation, frame, cladding) as late as possible during manufacture. One result is simplified handling which means that the earlier assembly stages could well be robotized. Fitting other sub-assemblies, eg. doors and hobs, is very easily performed around the frame of preferred embodiments of the present invention.

SUMMARY OF THE INVENTION

The present invention provides apparatus comprising at least one cooking chamber, said chamber being delimited by a generally rectangular muffle having an open face, heater elements being disposed inside the muffle and/or outside the muffle in a contiguous chamber, and a thermally insulating material covering the side walls of the muffle together with said contiguous chamber if present, said thermally insulating material constituting the core of a frame for the apparatus and forming a part of a structure which provides at least a portion of the outside walls of the apparatus, the improvement wherein the thermally insulating material is moulded over the side walls of the muffle together with said contiguous chamber if present.

Advantageously, the thermally insulating material is in the form of a foam.

Preferably the foam is based on organic resin, such as polyurethane resin, phenol resin, or furan resin, but it could alternatively be based on an expanded inorganic material.

In one particular embodiment, the apparatus comprises at least one layer of primary insulation located between the muffle and the thermally insulating material.

BRIEF DESCRIPTION OF THE DRAWINGS

Embodiments of the invention is described by way of example with reference to the accompanying drawings, in which.

MORE DETAILED DESCRIPTION

Figure 1:
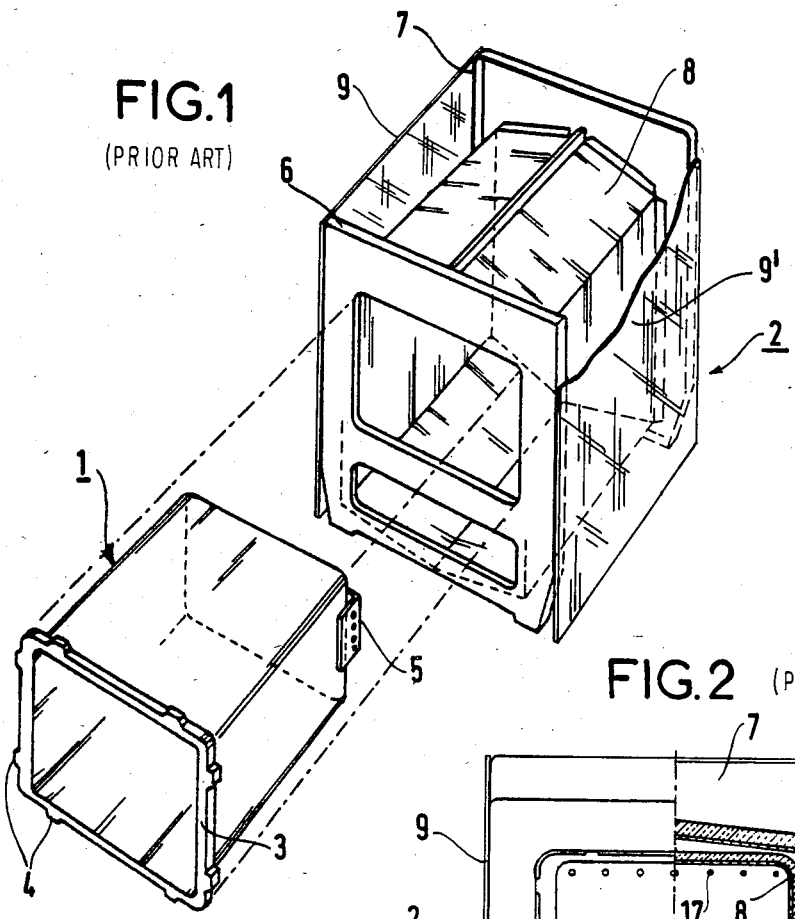
FIG.1 (PRIOR ART)
FIG. 1 is an exploded perspective view of a prior art cooking chamber.

In FIG. 1 which shows a prior art cooking chamber, the cooking chamber is delimited by a muffle 1 having an open front face surrounded by a rim 3 including outwardly projecting tabs 4 for positioning the muffle relative to the façade 6 of a frame 2. Brackets 5 at the back of the muffle and having holes to minimise heat losses serve to fix the muffle to a back sheet 7 of the frame 2. The frame 2 thus comprises four sheets welded together: the façade 6, a back sheet 7, and a chest 8 comprising two half-shells. On each side of the chest, a sheet of external cladding 9 or 9' is fixed between the façade 6 and the back sheet 7, thereby delimiting two chimney ducts between the chest and the external cladding.

Figure 2:
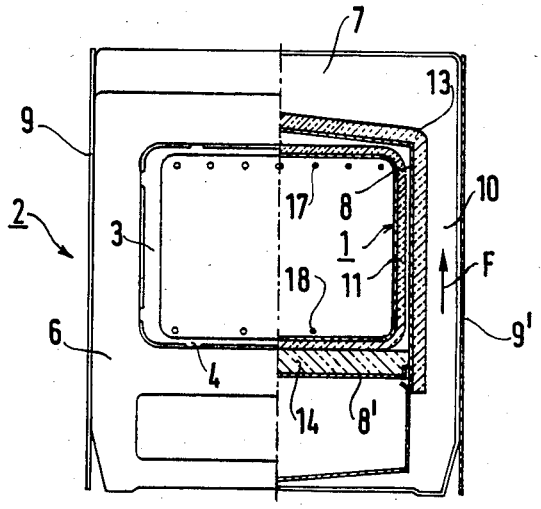
FIG.2 (PRIOR ART)
FIG. 2 is a front view of the FIG. 1 cooking chamber drawn in half section.

The non-sectioned half of FIG. 2 shows the outer cladding 9 and rim 3 together with its tabs 4 in contact with the façade 6.

The sectioned half shows the muffle 1 covered with heat insulation 11 on at least four of its faces. The chest 8 is covered with external heat insulation 13 placed on its upper surfaces and over its sides, and has internal heat insulation 14 placed on a bottom sheet 8' thereof. A chimney duct 10 between the insulated chest 8 and the external cladding 9' serves to circulate air as symbolised by an arrow F. Likewise, on the other side of the apparatus, there is a corresponding chimney duct between the chest 8 and the external cladding 9. Heater elements 17 and 18 are located inside the cooking chamber in the example shown.

Figure 3:
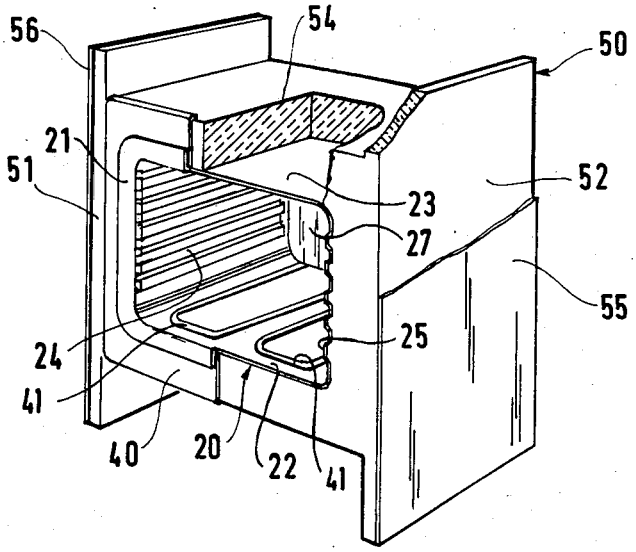
FIG. 3 is a partially cut away perspective view of a first cooking chamber in accordance with the invention.

FIG. 3 shows a first embodiment of the invention in which an enamelled steel muffle 20 has an open face surrounded by a rim 21 for use as a bearing surface by a sealing ring mounted on an access door (not shown) for the chamber. The muffle has four walls referred to as: bottom 22; top 23; and sides 24 and 25. A back plate 27 is applied to the muffle 20 and is thermally insulated independently of the insulation for the said walls of the muffle.

Heater elements 41 are located inside the muffle, and the top, bottom and sides of the muffle are covered by a thermally insulating material 50 in the form of a moulded insulation body. The insulating material constitutes the core of the frame of the apparatus, which frame comprises two side walls 51, 52, and top and bottom walls 53 and 54. The left and right side walls 51 and 52 extend upwardly and downwardly to constitute the external sides of the cooking apparatus.

These sides may also project forwardly to protect adjacent kitchen units from the cooking chamber.

The sides 51 and 52 of insulating material 50 may be covered externally with metal or plastic sheets 55 and 56 which improve appearance and contribute to making the assembly more rigid.

The front face of the insulating material is subjected to greater temperatures because of the rim 21 of the muffle 20, and a thin and/or perforated metal front plate 40 is provided in order to limit heat transmission away from the chamber.

Figure 4:
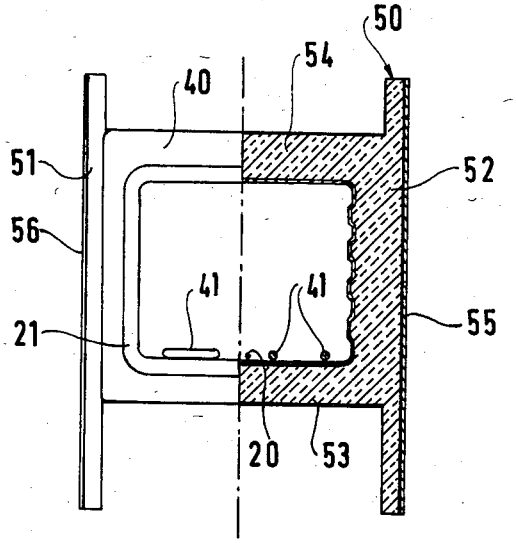
FIG. 4 is a front view of the FIG. 3 cooking chamber drawn in half section.

In FIG. 4, the non-sectioned half shows a heater element 41, the rim 21 of the muffle 20, the wall 51 of the insulating material 50, the thin metal plate 40, and the metal or plastic sheet 56 covering the outside face of the side wall 51.

The sectioned half also shows a heater element 41, together with the various component parts of the cooking apparatus, ie. the muffle 20, the insulating material 50 having walls 52, 53 and 54, and a metal or plastic sheet 55 covering the outside of the wall 52.

The insulating material 50 is thus generally H-shaped, with the two risers of the H being constituted by the side walls 51 and 52.

Other parts of the apparatus may be attached to these risers, eg. a drawer underneath the chamber for storage and a hob plate above it.

The insulating material may be obtained by casting or by injecting a foam capable of insulating a cooking chamber at 300° F. if manually cleaned or at 500° C. if pyrolytically cleaned, and being strong enough mechanically to ensure that the cooking apparatus is sufficiently rigid.

Hollow insulating bodies may be embedded in the insulating material in order to reduce the cost of the resulting cooking apparatus without spoiling the insulating and mechanical properties of the apparatus.

If the foam is based on furan resins, it may be necessary to mix in reinforcing material to increase its strength and also to vary its coefficient of thermal conductivity.

The density of the foam may also be adjusted to vary its mechanical and thermal properties.

The edges of the insulating material may be protected by metal strips which will also serve to make the apparatus more rigid.

Figure 5:
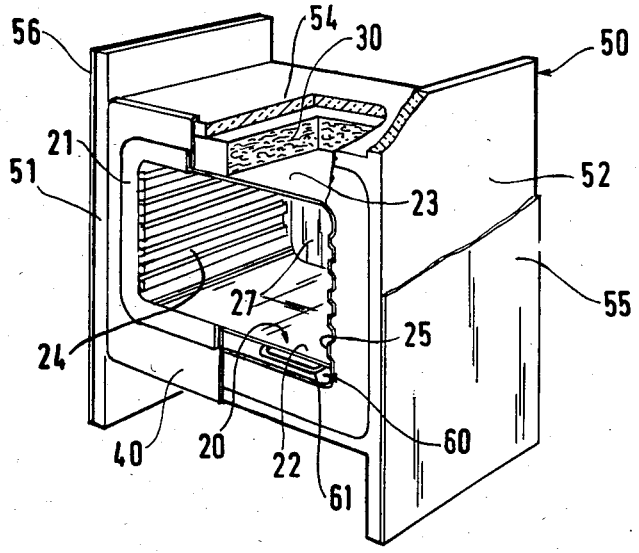
FIG. 5 is a partially cut away perspective view of a second cooking chamber in accordance with the invention.

FIG. 5 shows a second embodiment of the invention in which the muffle 20 has a contiguous chamber 60 adjacent thereto in which heater elements 61 are placed. It will readily be understood that a cooking chamber may have internal heater elements 41 only, as shown in FIG. 3, or external heater elements 61 in a contiguous chamber only, or a combination of internal and external heater elements 41 and 61.

The contiguous chamber is placed under the bottom 22 of the muffle, and the contiguous chamber 60 together with the top 23 and the sides 24 and 25 of the muffle are covered with primary insulation 30 which may be made up of several layers, eg. a blanket of inorganic fibers (silica-alumina, glass wool, rock wool) which may be deposited by flocking or preformed in slabs.

The primary insulation could alternatively be made of compressed powder material held together by textile covering, inorganic foam, eg. foamed glass or asbestos, granules of expanded mica, or other insulating granules.

The insulating material 50 surrounding the primary insulation has the same properties as described for the first embodiment.

Figure 6:
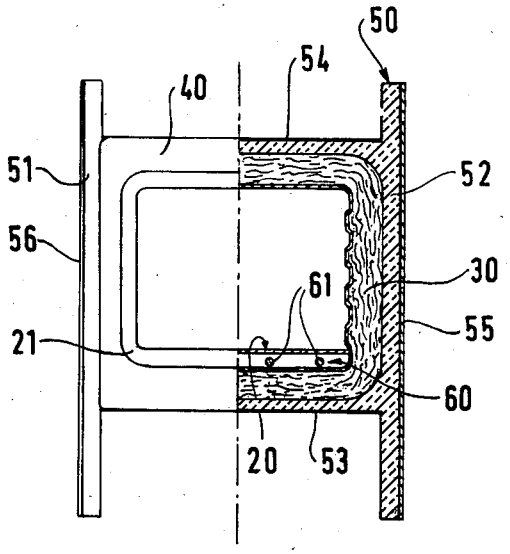
FIG. 6 is a front view of the FIG. 5 cooking chamber drawn in half section.

The non-sectioned half of FIG. 6 shows the rim 21 of the muffle 20, the wall 51 of insulating material 50, the thin metal plate 40, and the metal or plastic sheet 56 covering the outside of the wall 51.

The sectioned half shows the heater element 61 in the contiguous chamber 60, together with the other parts of the cooking apparatus: the muffle 20, the insulation 30, the insulating material 50 having walls 52, 53 and 54, and a metal or plastic sheet 55 covering the outside of the wall 52.

Without going beyond the scope of the invention, the cooking chamber apparatus may constitute a cooker using any kind of fuel, an oven for building into a kitchen unit, or a cooking apparatus having a plurality of ovens.

We claim:

1. Apparatus comprising at least one cooking chamber, said chamber being delimited by a generally rectangular metal muffle having an open face and including top, bottom and laterally spaced side walls forming a muffle chamber, heater elements being operatively disposed relative to said muffle for heating said muffle interior, a frame supporting said muffle, and a thermally insulating material covering said walls of the muffle and interposed between said muffle and said frame, the improvement wherein said thermally insulating material comprises a unitary moulded thermal insulation body completely moulded about at least the opposed side walls and top and bottom walls of said muffle and moulded to said frame and functioning as the sole support for said muffle on said frame without any heat bridges therebeween, thereby limiting heat loss from the muffle chamber by conduction and improving the mechancal strength of said apparatus.

2. Apparatus according to claim 1, wherein said unitary moulded thermal insulation body comprises a foam thermal insulating material.

3. Apparatus according to claim 2, wherein said foam is an organic resin of the group consisting of: polyurethane resin; phenol resin; and furan resin.

4. Apparatus according to claim 2, wherein the foam is an expanded inorganic material.

5. Apparatus according to claim 1, wherein hollow insulating bodies are embedded in the thermally insulating material.

6. Apparatus according to claim 1, further including at least one layer of primary thermal insulation located in between the muffle and said moulded thermal insulation body.

7. Apparatus according to claim 6, wherein said primary insulation includes a blanket of inorganic fibers.

8. Apparatus according to claim 7, wherein said inorganic fibers are chosen from the group consisting of glass wool, rock wook, and silica-alumina fibers.

9. Apparatus according to claim 6, wherein said primary insulation comprises a blanket of inorganic foam.

10. Apparatus according to claim 6, wherein said primary insulation comprises a blanket of insulating granules.

11. Apparatus according to claim 10, wherein said insulating granules are granules of expanded mica.

* * * * *